US011518662B2

(12) United States Patent
Hsu et al.

(10) Patent No.: US 11,518,662 B2
(45) Date of Patent: Dec. 6, 2022

(54) LID OPENING DEVICE AND SUCTION SYSTEM

(71) Applicant: ASIA IC MIC-PROCESS, INC., Taipei (TW)

(72) Inventors: Hung-Hsin Hsu, Taipei (TW); Yan-Lan Chiou, Taipei (TW)

(73) Assignee: ASIA IC MIC-PROCESS, INC., Taipei (TW)

( * ) Notice: Subject to any disclaimer, the term of this patent is extended or adjusted under 35 U.S.C. 154(b) by 240 days.

(21) Appl. No.: 16/861,637

(22) Filed: Apr. 29, 2020

(65) Prior Publication Data

US 2021/0339995 A1 Nov. 4, 2021

(51) Int. Cl.
*B67B 7/14* (2006.01)

(52) U.S. Cl.
CPC ..... *B67B 7/14* (2013.01)

(58) Field of Classification Search
CPC .... B67B 7/14; B67B 7/00; B67B 7/18; B25B 13/58
USPC ..... 81/3.36, 57.11, 57.14, 57.5
See application file for complete search history.

(56) References Cited

FOREIGN PATENT DOCUMENTS

| | | | |
|---|---|---|---|
| CN | 209306139 | U | 8/2019 |
| KR | 20170017957 | A | 2/2017 |
| KR | 101979812 | B1 | 5/2019 |
| TW | 201914916 | A | 4/2019 |

OTHER PUBLICATIONS

Translation of KR101979812b, retrieved from Espacenet (Year: 2019).*

* cited by examiner

*Primary Examiner* — Orlando E Aviles
*Assistant Examiner* — Thomas Raymond Rodgers

(57) ABSTRACT

A lid opening component, a lid opening device, and a suction system are disclosed. The suction system includes the lid opening device and a suction assembly, wherein the lid opening device includes a positioning assembly and a lid opening assembly having the lid opening components, and the lid opening component includes a needle holder, a plurality of unpowered needles, and a drive part. The suction system identifies the locations of a container and its lids through the positioning assembly of the lid opening device, opens the container's lids by fitting the unpowered needles of the lid opening components in with the surfaces of the container's lids and rotating the lid opening components of the lid opening assembly, and by moving the suction assembly to the openings of the container, draws out the content in the container through the suction assembly.

19 Claims, 7 Drawing Sheets

7

LID OPENING DEVICE AND SUCTION SYSTEM

TECHNICAL FIELD

The present disclosure relates to a lid opening component, a lid opening device and a suction system, more particularly, to a lid opening component having unpowered needles capable of shaping into a formation corresponding to a surface pattern of a lid, a lid opening device that opens the lids with the lid opening components after identifying locations of the lids with a positioning assembly, and a suction system using the lid opening device.

BACKGROUND

In semiconductor and electronic factories, chemicals corresponding to different processes are often used, such as slurry for chemical mechanical planarization process in semiconductor industry. The chemicals are usually stored in solvent containers which are commonly equipped with two lids on top to seal the openings of the solvent containers. When the chemical solvent is to be drew out or refilled, the lids are removed first before subsequent steps can be performed. In general, the lid of the solvent container is a circular solid lid and has threads on the side and pattern on the top. The pattern is, for example, cross-shaped recess or polygonal recess. Referring to FIG. 1, which is a schematic diagram illustrating a conventional way of opening a lid, the conventional way to open a lid is mostly by manual work, wherein an operator A0 uses a lid opening tool A1 and applies force to the lid L1 when the lid opening tool A1 is disposed to fit the pattern on the top of the lid L1, so as to open or seal the lid L1. However, the conventional way of opening lid exposes the operator to the risk of chemical leakage or explosion.

Several automated lid opening equipment have been developed to improve work safety issues, wherein most equipment replace manpower with machines to open the lid. Nevertheless, because there could be many different types of pattern on the lid of the solvent container, in order to perform the lid opening process, the automated lid opening equipment must change its lid opening tool to one that matches the pattern formation of the lid before being used. Although this method improves the safety of operators, the issue about operational efficiency remains. In addition, not all of the automated lid opening equipment is designed with changeable lid opening tools and so lacks versatility.

SUMMARY

To solve the aforementioned issues, the present disclosure provides a lid opening component, a lid opening device, and a suction system, wherein the suction system includes the lid opening device that further includes the lid opening component. When drawing the content in a container using the suction system, the locations of the container and its lids are first identified through a positioning assembly of the lid opening device, then the lids are opened through the unpowered needles of the lid opening components shaped into a formation corresponding to patterns on the lids, and last a suction assembly of the suction system draws out the content in the container, wherein the driving force or the power of the lid opening component, the lid opening device and the suction system is supplied by a power source. The container is like a chemical solvent barrel, and the content is, for example but not limited to, liquid, gas, solid-liquid mixture and etc. The lid opening component, the lid opening device and the suction system are capable of performing the lid opening and content drawing processes automatically without involving any manpower. Further, there is no need to change lid opening tool that matches the pattern on the lid and so the work safety risk is reduced and the operational efficiency is enhanced.

An object of the present disclosure is to provide a lid opening component that includes a needle holder, a plurality of unpowered needles, and a drive part. The unpowered needles are movably disposed in the needle holder and are capable of correspondingly shifting in accordance to a pattern on a lid to fit in with a surface of the lid. The drive part is coupled to the needle holder and drives the needle holder to rotate after receiving a driving force so as to open the lid.

An object of the present disclosure is to provide a lid opening device that includes a positioning assembly and a lid opening assembly. The positioning assembly includes two positioning components disposed at two opposite ends, wherein the positioning assembly is mobile and the two positioning components are movable toward or away from each other, for identifying locations of a container and its lids. The lid opening assembly includes two lid opening components as aforementioned disposed at two opposite ends and on a same plane with the positioning assembly, wherein the two lid opening components are movable toward or away from each other. The positioning assembly and the lid opening assembly receive power from a power source, and after the positioning assembly identifies the locations of the lids, the lid opening assembly moves above the lids according to the identified locations of the lids and rotates to open the lids after the unpowered needles of the two lid opening components are fitted in with the surfaces of the lids.

Optionally, each of the two lid opening components of the lid opening assembly further includes a skirt and an evacuation device, wherein the skirt covers a periphery of the unpowered needles to form an internal space and the evacuation device is connected to the lid opening component. When the unpowered needles of each of the lid opening components are fitted in with the surface of the lid and the lid opening component is rotated to open the lid, the evacuation device evacuates air in the internal space to create a vacuum-like environment to engage the lid opening component and the lid more tightly.

Optionally, the lid opening assembly further includes a first movable part, wherein two ends of the first movable part are respectively coupled to the two lid opening components so that the two lid opening components can move toward or away from each other.

Optionally, each positioning component of the positioning assembly is an ultrasound distance measuring instrument, an infrared distance measuring instrument, or a positioning camera.

Another object of the present disclosure is to provide a suction system that includes the lid opening device as aforementioned and a suction assembly, wherein the suction assembly includes two suction components disposed at two opposite ends and are movable toward or away from each other. After the lid opening device opens the lids of the container, the suction assembly moves to openings of the container to draw out the content in the container.

Optionally, the suction assembly and the lid opening assembly of the lid opening device are crossed at a right angle. The suction assembly further includes a second movable part, wherein two ends of the second movable part are respectively coupled to the two suction components so that the two suction components can move toward or away from each other.

Optionally, the suction system further includes a container holding apparatus disposed below the lid opening device and the suction assembly.

Optionally, the container holding apparatus further includes at least one weighing device disposed in the container holding apparatus for monitoring the weight of the container and the content in the container.

Optionally, the suction system further includes a cross-arranged screw rod module having four screw rods, wherein the first movable part is two of the four screw rods and the second movable part is the other two of the four screw rods.

Optionally, the two lid opening components and the two suction components are respectively coupled to the four screw rods in an arrangement where the two lid opening components are disposed opposite each other and the two suction components are disposed opposite each other.

In short, the lid opening component, the lid opening device and the suction system disclosed by the present disclosure can identify the locations of the lids with the positioning assembly, open the lids with the unpowered needles of the lid opening components shaped into the formation conforming to the patterns of the lids, and draw out the content in the container with the suction assembly, so as to achieve the opening of the container lids and the drawing of the container content. The lid opening component, the lid opening device and the suction system of the present disclosure improve both the safety of the worker and the savings on time costs, and so are advantageous for markets that have needs in lid opening and content drawing; the content drawing is for example but not limited to liquid drawing and the markets are industries with processes like semiconductor, electronics and etc.

BRIEF DESCRIPTION OF THE DRAWINGS

The structure as well as preferred modes of use, further objects, and advantages of this present disclosure will be best understood by referring to the following detailed description of some illustrative embodiments in conjunction with the accompanying drawings, in which.

DETAILED DESCRIPTION OF THE PREFERRED EMBODIMENTS

The present disclosure provides a lid opening component, a lid opening device, and a suction system. The suction system opens lids of a container through the lid opening device and draws out the content in the container through a suction assembly; the container is, for example but not limited to, a chemical solvent barrel, and the content is, for example but not limited to, liquid, gas, solid-liquid mixture, etc. The lid opening device opens the lids by first using a positioning assembly having two positioning components to identify locations of the container and the lids. Next, two lid opening components of the lid opening device are moved according to the identification result such that the two lid opening components are correspondingly positioned above the lids, wherein generally, a container serving as the chemical solvent barrel has two lids. Then, multiple unpowered needles of each of the lid opening components shape into a formation corresponding to a pattern on the lid surface and after receiving a driving force, the lid opening component rotates to open the lid, wherein the rotating direction is not limited as the rotation can be clockwise or counterclockwise as required.

Figure 1:
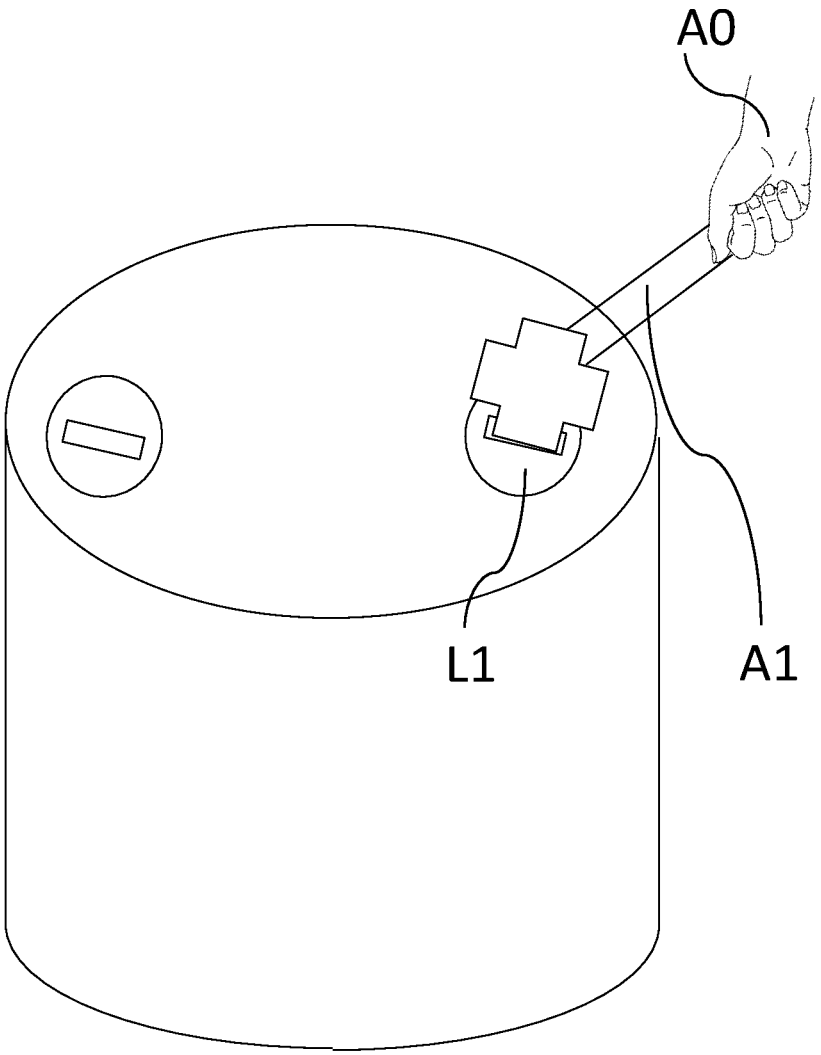
FIG. 1 (Prior Art)
FIG. 1 is a schematic diagram of a conventional way to open a lid.
Figure 2:
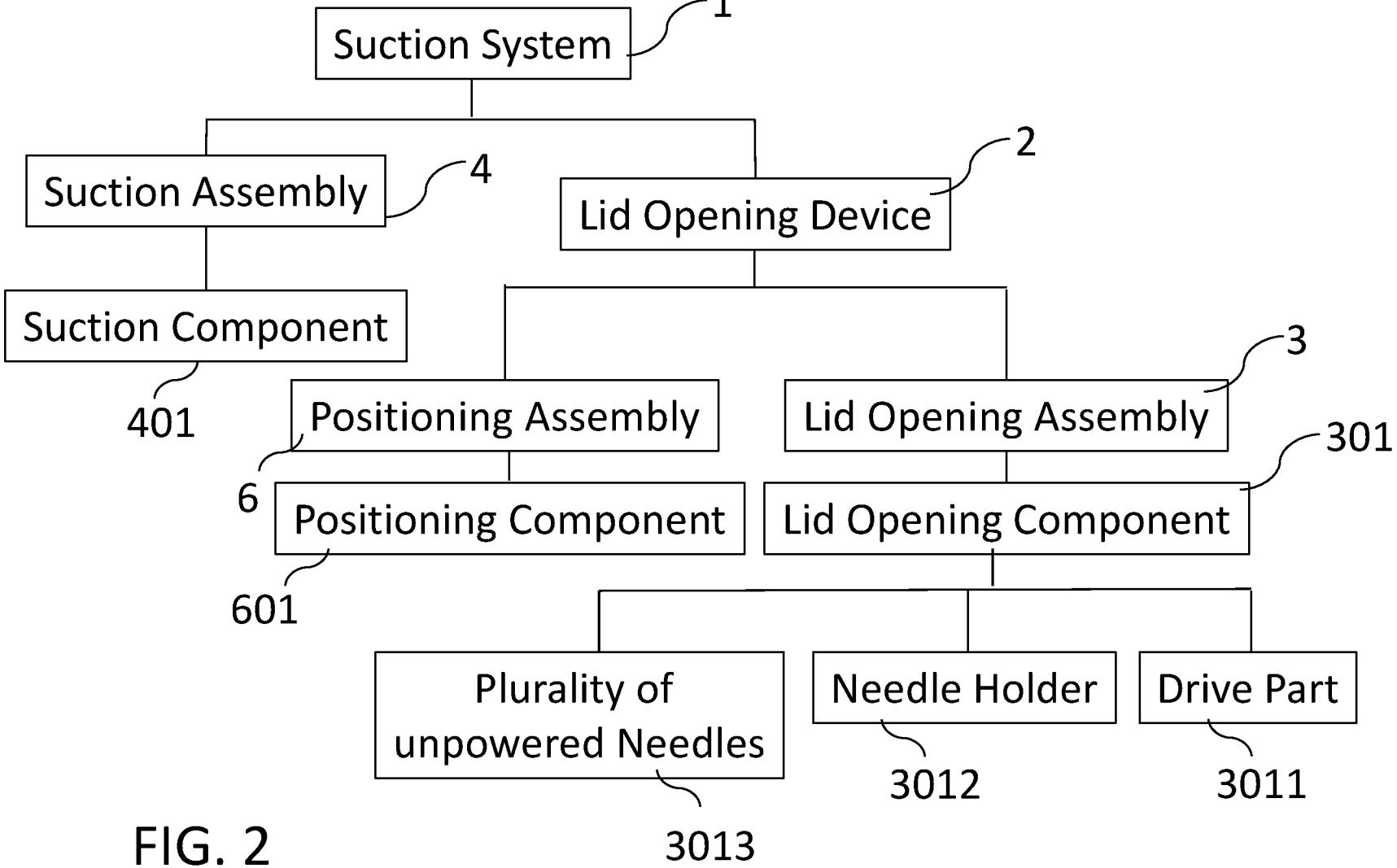
FIG. 2 is a schematic diagram illustrating component relationship of a suction system according to an embodiment of the present disclosure.

FIG. 2 is a schematic diagram illustrating component relationship of a suction system according to an embodiment of the present disclosure. As shown in FIG. 2, the suction system 1 includes a lid opening device 2 and a suction assembly 4, wherein the suction assembly 4 includes a suction component 401 and the lid opening device 2 includes a lid opening assembly 3 and a positioning assembly 6. The positioning assembly 6 includes two positioning components 601 and the lid opening assembly includes two lid opening components 301, wherein each of the lid opening components 301 includes a drive part 3011, a needle holder 3012, and a plurality of unpowered needles 3013.

Figure 3A:
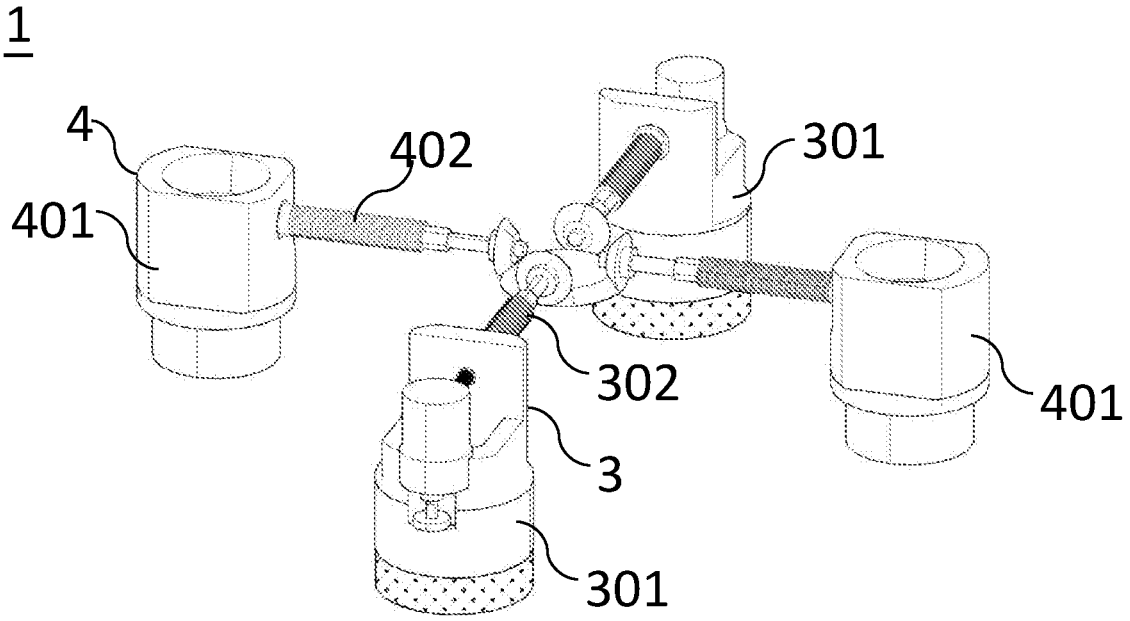
FIG. 3A is a schematic diagram of a suction system according to an embodiment of the present disclosure.
Figure 3B:
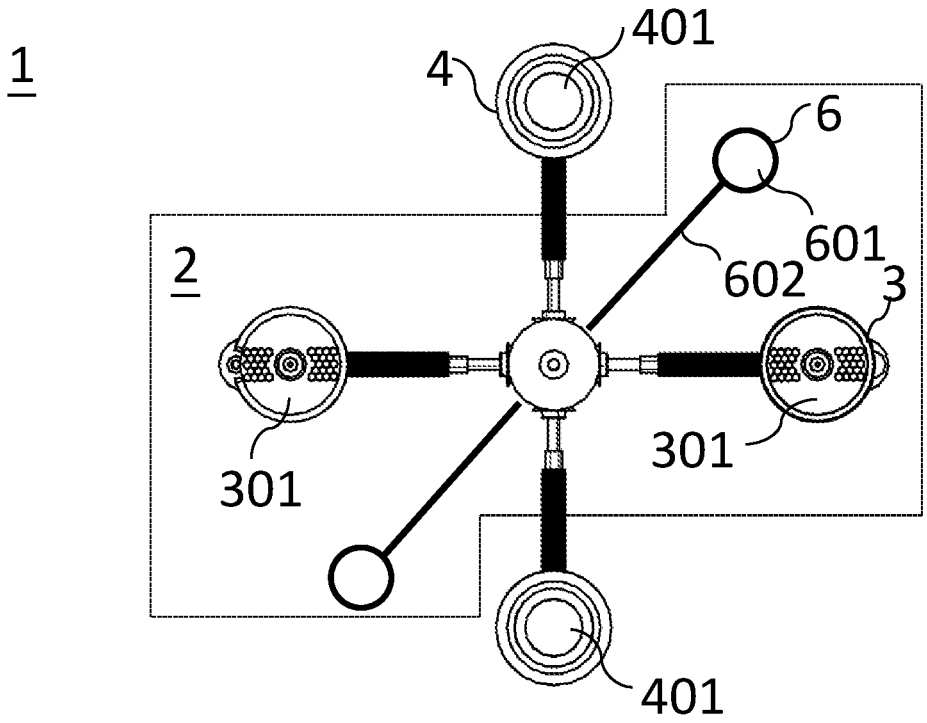
FIG. 3B is a bottom view of a suction system according to an embodiment of the present disclosure.

Referring to FIG. 3A and FIG. 3B for detail description of the suction system and the lid opening device. FIG. 3A and FIG. 3B are respectively the schematic diagram and the bottom view of a suction system according to an embodiment of the present disclosure. As shown in FIG. 3A and FIG. 3B, the suction system 1 includes the suction assembly 4 and the lid opening device 2, wherein the lid opening device 2 further includes the positioning assembly 6 and the lid opening assembly 3. The positioning assembly 6 includes two positioning components 601 that are disposed at two ends opposite to each other, wherein the two positioning components 601 are coupled through a movable part 602 so that the two positioning components 601 can move toward or away from each other. The movable part 602 is, for example but not limited to, a combination of two screw rods, two linear actuator, or two uniaxial actuators. The lid opening assembly 3 includes two lid opening components 301 that are disposed at two ends opposite to each other, wherein the two lid opening components 301 are coupled through a movable part 302 so that the two lid opening components 301 can move toward or away from each other. The movable part 302 is, for example but not limited to, a combination of two screw rods, two linear actuators, or two uniaxial actuators. In one embodiment, the lid opening assembly 3 and the positioning assembly 6 are located on the same plane, and the lid opening assembly 3 and the positioning assembly 6 are configured to displace by approximately 45 degrees in arrangement, but the present disclosure is not limited thereby. The lid opening assembly 3 and the positioning assembly 6 are capable of three-dimensional movement after receiving power from a power source (not illustrated).

Figure 3C:
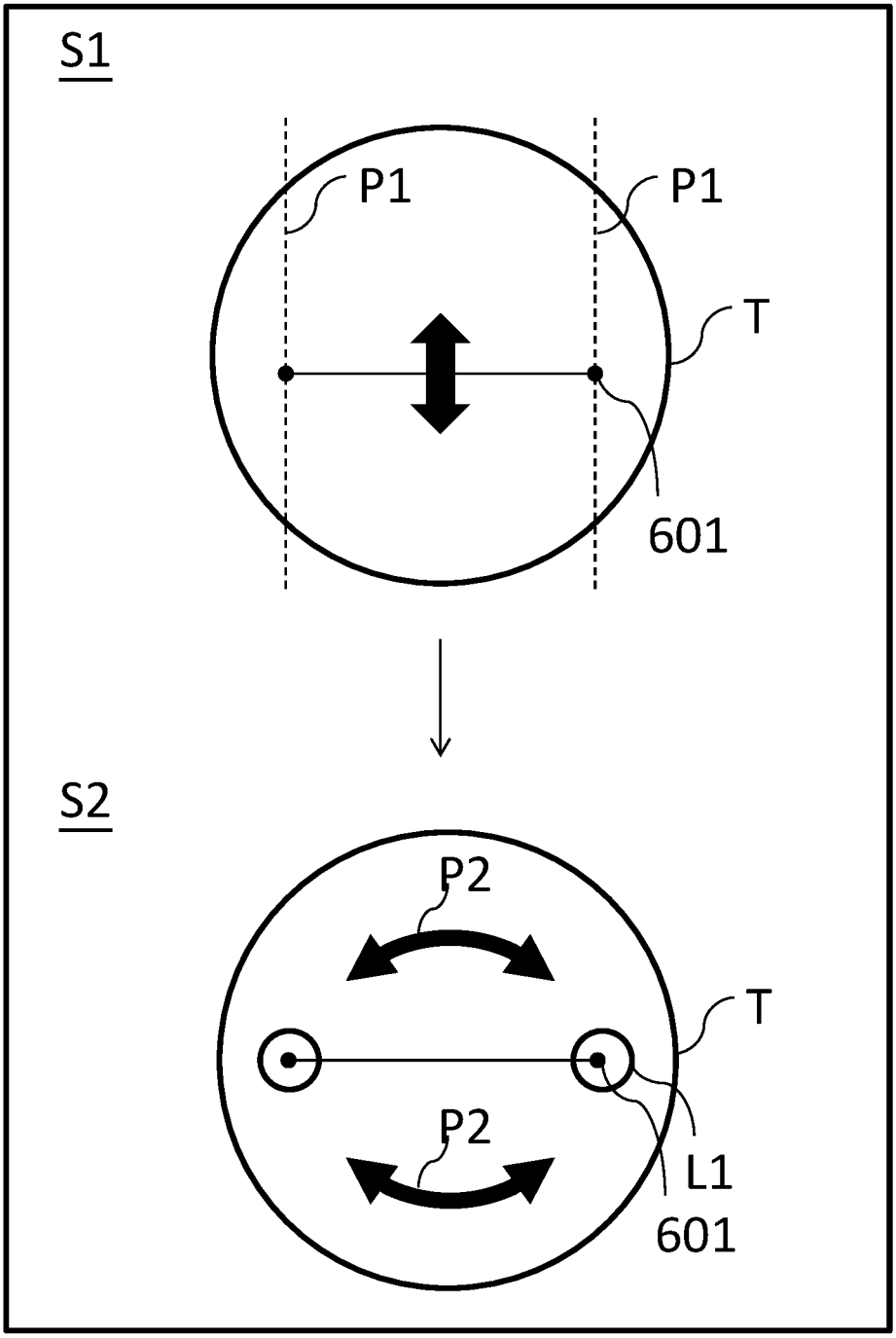
FIG. 3C is schematic diagram illustrating steps of a positioning component identifying locations of a container and lids according to an embodiment of the present disclosure.

The positioning component 601 is, for example but not limited to, an ultrasound distance measuring instrument, an infrared distance measuring instrument, or a positioning camera. Referring to FIG. 3C, which is a schematic diagram illustrating how a positioning component 601 identifies a container and its lids according to an embodiment of the present disclosure. First, in step S1 shown in FIG. 3C, the positioning component 601 and the container T move relatively along path P1 to identify four points on the periphery of the container T so as to calculate and find the center of the container T. To achieve the identification, the distance between the two positioning components 601 must be smaller than the diameter of the container T, and the two positioning components 601 are located at two sides of the center of the container T. The relative movement along path P1 is not limited by the positioning component 601 doing the move or the container T doing the move. Next, step S2 in FIG. 3C is the positioning component 601 conducting a second identification to find a middle point between two lids for subsequent use by the lid opening device for positioning and lid opening purposes. The positioning component 601 and the container T move relatively along path P2, which either the positioning component 601 moves or the container T moves, to identify the locations of two lids L1 and to calculate the middle point between the two lids L1, wherein the two positioning components 601 of the positioning assembly 6 further move near or away horizontally to accurately find the locations of the two lids L1. In the process of the positioning component 601 identifying the container and the lid, step S1 is not an essential step, wherein the spirit of the positioning component 601 is to identify the center of the two lids L1 such that the lid opening device is able to position accordingly in subsequent lid opening process. When the positioning component is a positioning component like infrared distance measuring instrument that does not need light and is operable in darkness, the present disclosure suits the trend of unmanned factory even more.

Figure 4A:
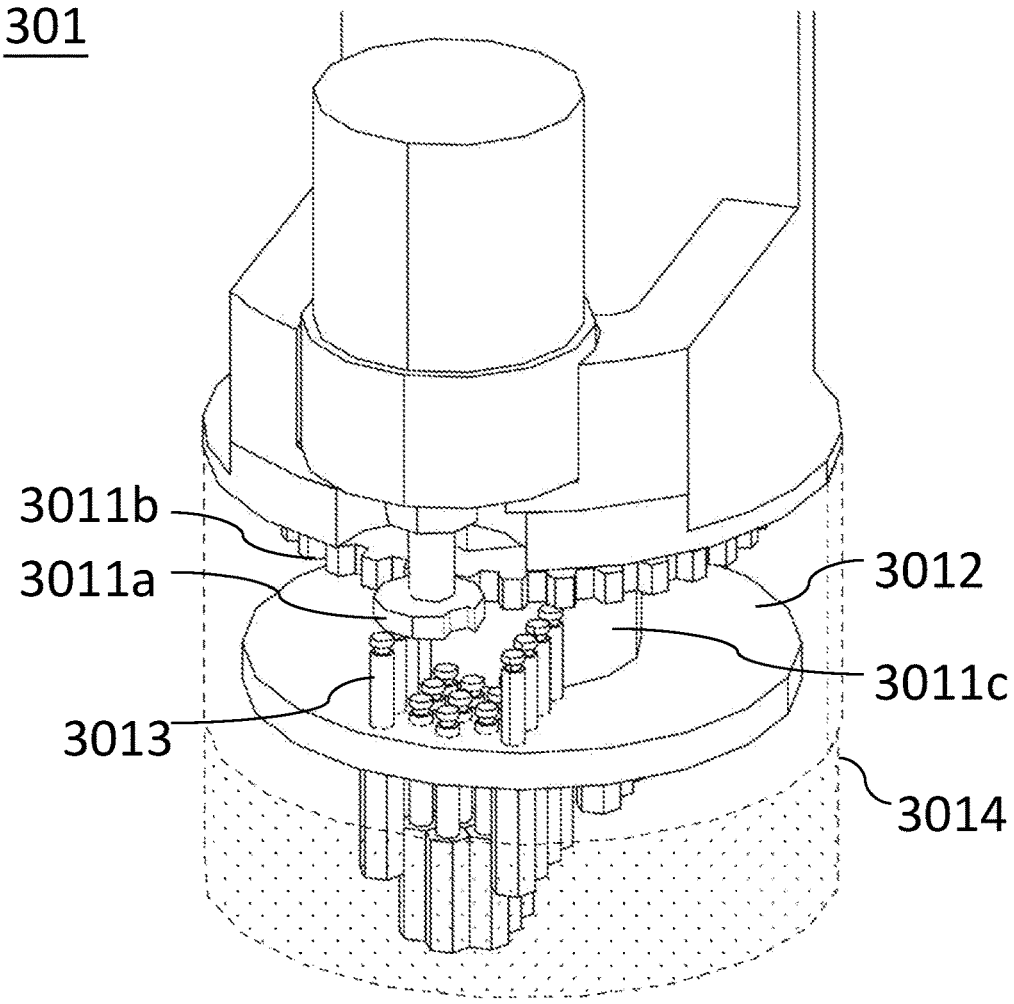
FIG. 4A is a perspective view of a lid opening component according to an embodiment of the present disclosure.
Figure 4B:
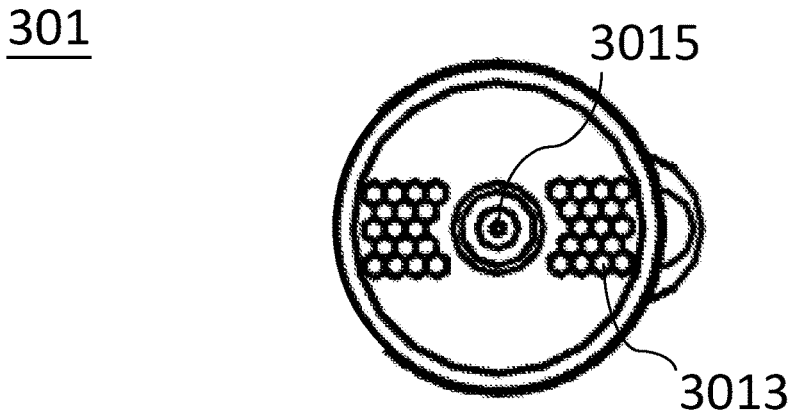
FIG. 4B is a bottom view of a lid opening component according to an embodiment of the present disclosure.
Figure 4C:
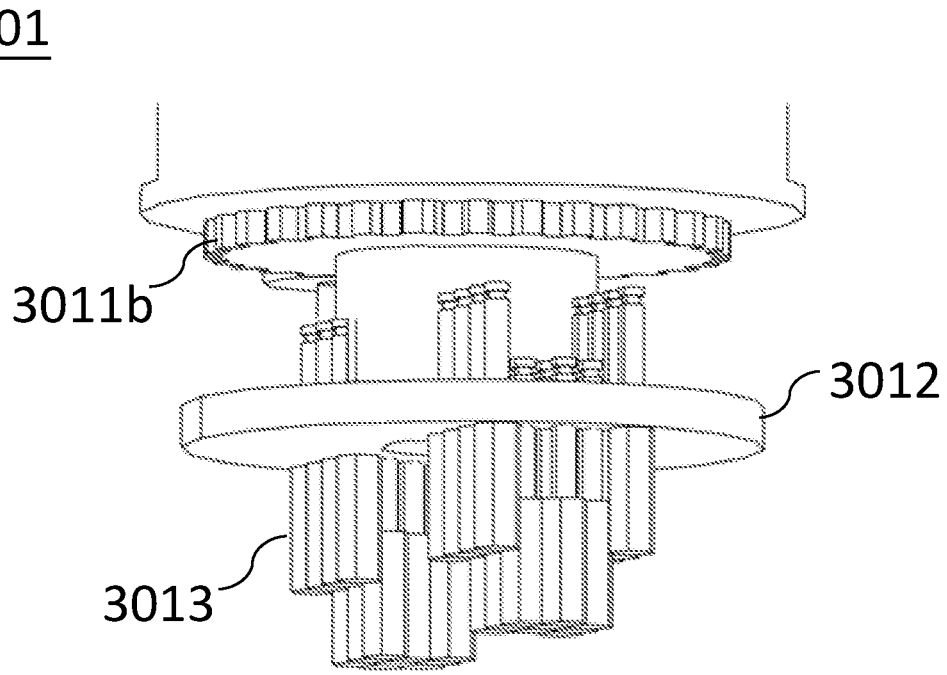
FIG. 4C is a schematic diagram of a lid opening component according to an embodiment of the present disclosure.
Figure 4D:
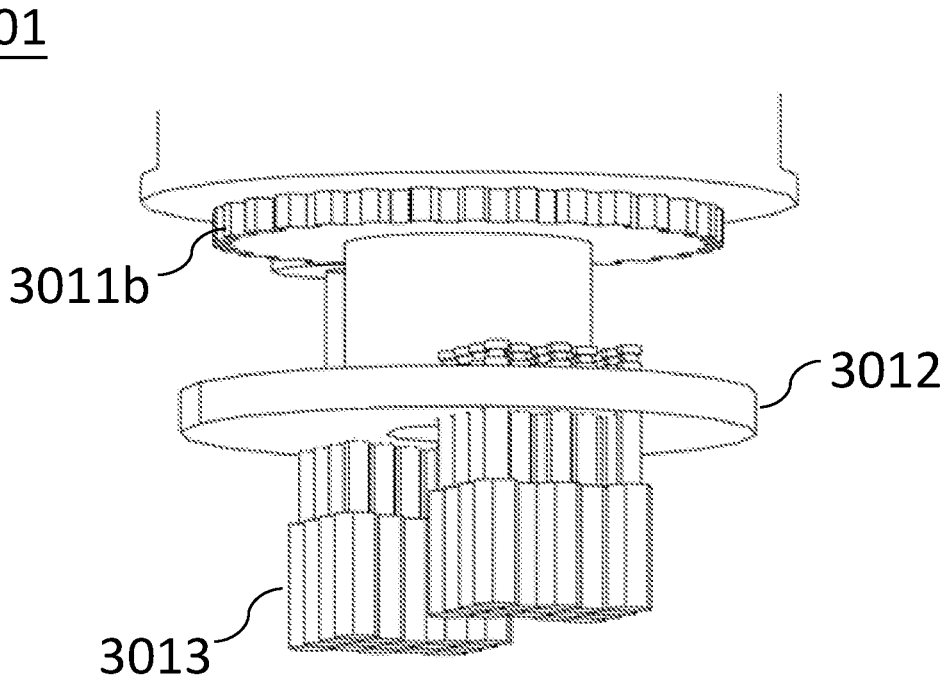
FIG. 4D is a schematic diagram of a lid opening component according to an embodiment of the present disclosure.

After the operation of the positioning assembly is complete, the lid opening assembly moves according to the locations of the two lids and their middle point, such that the center of the two lid opening components is moved to the center of the two lids and the two lid opening components are moved above the lids of the container to execute lid opening process, wherein the lid opening assembly is able to move when it receives power supplied by a power source. FIGS. 4A to 4D are respectively a perspective view, a bottom view, two schematic diagrams of a lid opening component according to an embodiment of the present disclosure. As shown in FIGS. 4A to 4D, the lid opening component 301 of the lid opening assembly includes the needle holder 3012, a plurality of unpowered needles 3013, and the drive part, wherein the unpowered needles 3013 are moveably disposed in the needle holder 3012 and the drive part is composed by a driving gear 3011*a*, a driven gear 3011*b* and a gear drive zone 3011*c* as shown in FIG. 4A. When the lid opening component 301 has not touched the lid, the unpowered needles 3013 fall naturally as shown in FIG. 4D. When the power source supplies power to move the lid opening component 301 towards the lid, the unpowered needles correspondingly form or shape into a formation in correspondence to the pattern on the surface of the lid accordingly, like the arrangement of unpowered needles shown in FIG. 4C but not limited thereto, and it is to be noted that the lid is not illustrated in FIG. 4C. In other words, the unpowered needles 3013 move correspondingly according to the pattern on the surface of the lid to fit in with the surface of the lid. The movement of the lid opening component 301 is, for example but not limited to, when the lid is below the lid opening device, the lid opening component 301 is moved downwards by the power source. Then, the drive part coupled to the needle holder 3012 drives the needle holder 3012 to rotate such that the unpowered needles 3013 drive the lid to rotate and thus the lid is opened. In the present disclosure, the way the drive part works is that the driving gear 3011*a* drives the driven gear 3011*b* to turn in order to drive the gear drive zone 3011*c* and the needle holder 3012 to rotate, but the present disclosure is not limited thereby. Any mechanism that drives the needle holder to move is deemed to be the same as the present disclosure, for example, the needle holder 3012 can be coupled to a shaft, or the needle holder 3012 could be designed to couple to the power source directly, where the drive part can be a shaft or a component coupled to the power source.

The lid opening component 301 further includes a skirt and an evacuation device to assist the opening and removing of the lid. Referring to FIGS. 4A and 4B, the lid opening component 301 has the skirt 3014 disposed to cover around the periphery of the unpowered needles to form an internal space, and the evacuation device connected to the lid opening component 301. The evacuation device 3015 disposed in the internal space of the skirt 3014 evacuates air in the internal space when the unpowered needles 3013 are fitted in with the surface of the lid and rotated to open the lid, so that the internal space is made into a vacuum-like environment, and therefore, the lid and the unpowered needles 3013 are more tightly engaged for ease of opening and removing the lid. The present disclosure does not limit the material or the modelling of the skirt, whether it be a soft curtain cut into strips or an uncut curtain tied around the periphery of the lid opening component. In addition, the present disclosure does not limit the type or location of the evacuation device, any evacuation device capable of achieving a vacuum-like environment in the internal space is deemed to be inclusive in the concept of the present disclosure.

When the lid of the container is opened and removed, the suction assembly of the suction system acts upon receiving power from the power source to draw out the content in the container. Referring to FIGS. 3A and 3B, the suction assembly 4 includes two suction components 401 disposed at two ends opposite to each other, wherein the two suction components 401 are coupled through a movable part 402 such that the two suction components 401 can move toward or away from each other. The movable part 402 is, for example but not limited to, a combination of two screw rods, two linear actuators, or two uniaxial actuators. The suction assembly 4 and the lid opening assembly 3 are, but not limited to, crossed at right angles, and the two suction components 401 and the two lid opening components 301 can be coupled to a moveable part with four axles. In other words, the movable part is a cross-arranged screw rod module with four screw rods, and the four screw rods are respectively coupled to two suction components 401 and two lid opening components 301, wherein the two suction components 401 are arranged opposite to each other and the two lid opening components 301 are arranged opposite to each other. The four screw rods of the cross-arranged screw rod module can act in parallel to achieve horizontal displacement of the suction components and the lid opening components on the same plane, and thus the action performed by the conventional expensive mechanical arm can be substituted to save cost. In addition, the cross-arranged screw rod module with four screw rods further includes an axis so that the suction components and the lid opening components coupled to the four screw rods can perform three-dimensional movement. However, the present disclosure is not limited by the cross-arranged screw rod module with four screw rods. After the lids are removed from the container, the suction assembly 4 moves, after receiving power supplied by the power source, based on the original locations of the lids so that the suction components 401 are moved above the openings of the container at where the lids originally were to draw out the content in the container. The present disclosure does not limit the style and type of the suction component, for example, it can be a connection valve unit installed with different pipes and connectors.

Figure 5:
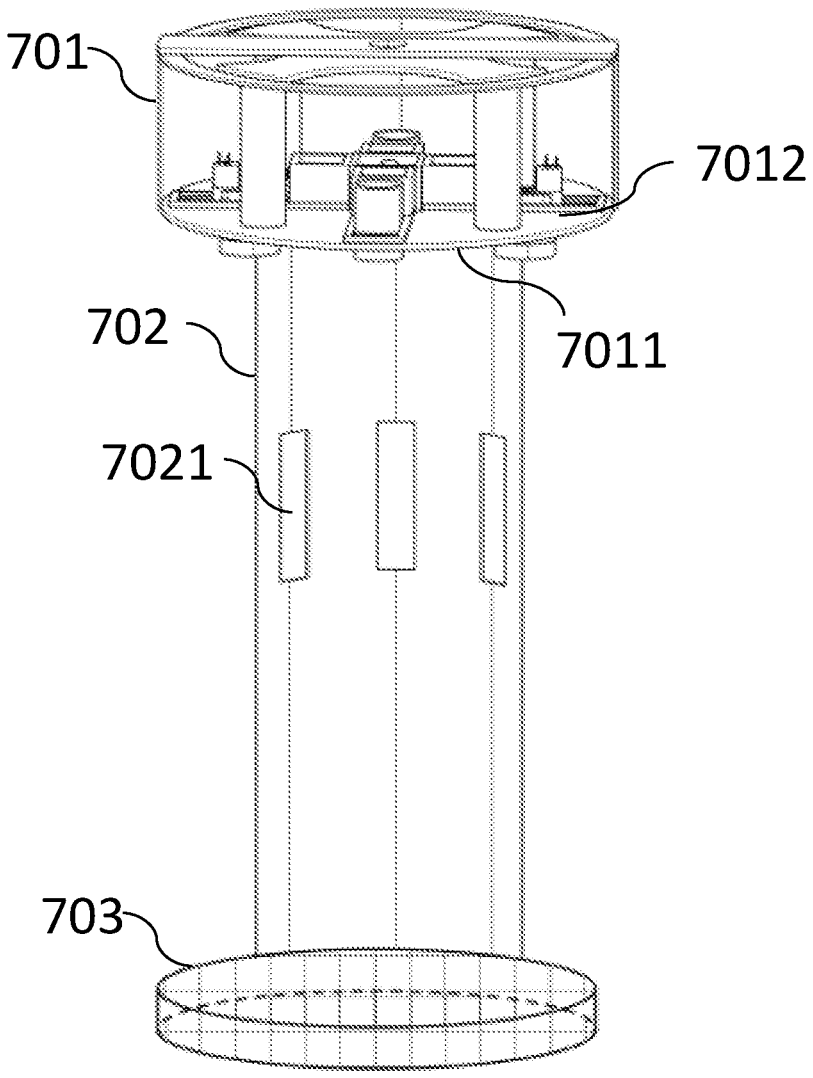
FIG. 5 is a schematic diagram of a container holding apparatus according to an embodiment of the present disclosure.

The suction system further includes a container holding apparatus to hold the container in place so that the positioning, the lid opening, and the drawing content processes can be performed more accurately. Referring to FIG. 5, which is a schematic diagram of a container holding apparatus according to an embodiment of the present disclosure, the container holding apparatus 7 includes a top holder 701, a side holder 702, and a bottom seat 703. The top holder 701 has a holding zone 7011 and a holding plate 7012, wherein the holding zone is for holding the top part of the container, and the holding plate 7012 is for placing the suction assembly and the lid opening device. The side holder 702 holds the sides of the container and restricts the position of the container through baffles 7021, wherein the side holder 702 can be designed to have a shape conforming to the sides of the container, such as arced surface of a barrel, to strengthen the supportiveness. The bottom seat 703 is for placing the container thereon. Moreover, the container holding apparatus further includes at least one weighing device for monitoring the weights of the container and the content in the container at all times. The weighing device can be disposed at the side holder or the bottom seat, but the present disclosure does not limit the number and installing location of the weighing device.

Next, the entire operation of the suction system is described. First, the suction system identifies the locations of the lids of the container by using the positioning assembly. Based on the locations of the lids, the two lid opening components of the lid opening assembly are moved above the lids, and through the unpowered needles of the two lid opening components fitted in the patterns on the surfaces of the lids, drive the lids to open, and with the assistance of the skirts and the evacuation devices enhancing the tightness between the unpowered needles of the two lid opening components and the lids, the lids are removed. Further, based on the original locations of the lids, the suction assembly is moved above the openings of the container, which are the original locations of the lids, and draws the content in the container to conduct the drawing process. The lid opening component, the lid opening device, and the suction system can also be applied in lid closing process, where the unpowered needles of the lid opening component are fitted in with the lid and moved above the opening, and the lid opening component is further rotated to lock the lid to the container.

In view of above, the technical benefits of the lid opening component, the lid opening device, and the suction system as described by the embodiments of the present disclosure, in comparison to the conventional technology, are described below.

In conventional technology, the lid opening process is often operated manually and exposes operators in the danger of chemical leakage, and so automated lid opening equipment is developed. However, the current automated lid opening equipment still requires time and labor to change lid opening tools for different lids, which limits the efficiency of lid opening operations. On the other hand, the lid opening component, the lid opening device, and the suction system of the present disclosure use low cost positioning components and lid opening components to open lids, wherein the unpowered needles of the lid opening components are capable of shaping a corresponding formation according to different lid patterns and so the time and labor needed to change lid opening tools is omitted. The lid opening device in combination with the suction system completes the drawing process in full automation, wherein the positioning assembly of the lid opening device can further be positioning components that do not require light, and so the lid opening device and the suction system of the present disclosure can operate in the darkness, and thereby meets the trend of unmanned factory.

The above disclosure is only the preferred embodiment of the present disclosure, and not used for limiting the scope of the present disclosure. All equivalent variations and modifications on the basis of shapes, structures, features and spirits described in claims of the present disclosure should be included in the claims of the present disclosure.

What is claimed is:

1. A lid opening device comprising:

a positioning assembly, comprising two positioning components disposed respectively at two opposite ends, wherein the positioning assembly is mobile and the positioning components are movable toward or away from each other, for identifying locations of a container and lids of the container; and a lid opening assembly, comprising two lid opening components disposed respectively at two opposite ends and on the same plane as the positioning assembly, wherein the lid opening components are movable toward and away from each other and each lid opening component comprises:

a needle holder; a plurality of unpowered needles movably disposed in the needle holder for correspondingly shifting in accordance to a pattern on a surface of a lid to fit in with the surface of the lid; and a drive part coupled to the needle holder for driving the needle holder to rotate to open the lid after receiving a driving force;

wherein the positioning assembly and the lid opening assembly receive power from a power source, the positioning assembly identifies the locations of the lids, and the lid opening assembly moves above the lids according to the identified locations of the lids and rotates after the unpowered needles of the lid opening components fit in with surfaces of the lids to open the lids.

2. The lid opening device of claim 1, wherein the lid opening component of the lid opening assembly further comprises:

a skirt disposed to cover a periphery of the unpowered needles and form an internal space; and an evacuation device connected to the lid opening component;

wherein when the unpowered needles are fitted in with the surface of the lid and the lid opening component is rotated to open the lid, the evacuation device evacuates air in the internal space to create a vacuum-like environment for engaging the lid opening component and the lid more tightly.

3. The lid opening device of claim 1, wherein the lid opening assembly further comprises:

a first movable part, wherein the two lid opening components are coupled to two ends of the first movable part to move toward or away from each other.

4. The lid opening assembly of claim 1, wherein each of the positioning components of the positioning assembly is an ultrasonic distance measuring instrument, an infrared distance measuring instrument, or a positioning camera.

5. A suction system, comprising:

a lid opening device comprising: a positioning assembly, comprising two positioning components disposed respectively at two opposite ends, wherein the positioning assembly is mobile and the positioning components are movable toward or away from each other, for identifying locations of a container and lids of the container; and a lid opening assembly, comprising two lid opening components disposed respectively at two opposite ends and on the same plane as the positioning assembly, wherein the lid opening components are movable toward and away from each other and each lid opening component is comprises: a needle holder; a plurality of unpowered needles movably disposed in the needle holder for correspondingly shifting in accordance to a pattern on a surface of a lid to fit in with the surface of the lid; and a drive part coupled to the needle holder for driving the needle holder to rotate to open the lid after receiving a driving force; wherein the positioning assembly and the lid opening assembly receive power from a power source, the positioning assembly identifies the locations of the lids, and the lid opening assembly moves above the lids according to the identified locations of the lids and rotates after the unpowered needles of the lid opening components fit in with surfaces of the lids to open the lids; and a suction assembly, comprising two suction components disposed respectively at two opposite ends, wherein the suction components are movable toward or away from each other; wherein after the lid opening device opens the lids of the container, the suction assembly moves to openings of the container to draw out the content in the container.

6. The suction system of claim 5, wherein the suction assembly and the lid opening assembly of the lid opening device are crossed at a right-angle, and the suction assembly further comprises a second movable part having two ends respectively coupled with the two suction components for moving the two suction components toward or away from each other.

7. The suction system of claim 6, further comprising a cross-arranged screw rod module having four screw rods, wherein the two lid opening components and the two suction components are respectively coupled to the four screw rods in an arrangement where the two lid opening components are disposed opposite each other and the two suction components are disposed opposite each other.

8. The suction system of claim 5, further comprising a container holding apparatus disposed below the lid opening device and the suction assembly.

9. The suction system of claim 8, wherein the container holding apparatus further comprises at least one weighing device disposed in the container holding apparatus for monitoring the weight of the container and the content in the container.

10. The suction system of claim 5, wherein the lid opening component of the lid opening assembly further comprises:

a skirt disposed to cover a periphery of the unpowered needles and form an internal space; and an evacuation device connected to the lid opening component;

wherein when the unpowered needles are fitted in with the surface of the lid and the lid opening component is rotated to open the lid, the evacuation device evacuates air in the internal space to create a vacuum-like environment for engaging the lid opening component and the lid more tightly.

11. The suction system of claim 10, wherein the suction assembly and the lid opening assembly of the lid opening device are crossed at a right-angle, and the suction assembly further comprises a second movable part having two ends respectively coupled with the two suction components for moving the two suction components toward or away from each other.

12. The suction system of claim 10, further comprising a container holding apparatus disposed below the lid opening device and the suction assembly.

13. The suction system of claim 12, wherein the container holding apparatus further comprises at least one weighing device disposed in the container holding apparatus for monitoring the weight of the container and the content in the container.

14. The suction system of claim 10, further comprising a cross-arranged screw rod module having four screw rods, wherein the two lid opening components and the two suction components are respectively coupled to the four screw rods in an arrangement where the two lid opening components are disposed opposite each other and the two suction components are disposed opposite each other.

15. The suction system of claim 5, wherein the lid opening assembly further comprises:

a first movable part, wherein the two lid opening components are coupled to two ends of the first movable part to move toward or away from each other.

16. The suction system of claim 15, wherein the suction assembly and the lid opening assembly of the lid opening device are crossed at a right-angle, and the suction assembly further comprises a second movable part having two ends respectively coupled with the two suction components for moving the two suction components toward or away from each other.

17. The suction system of claim 16, further comprising a cross-arranged screw rod module having four screw rods, wherein the first movable part is two of the four screw rods and the second movable part is the other two of the four screw rods.

18. The suction system of claim 15, further comprising a container holding apparatus disposed below the lid opening device and the suction assembly.

19. The suction system of claim 18, wherein the container holding apparatus further comprises at least one weighing device disposed in the container holding apparatus for monitoring the weight of the container and the content in the container.

* * * * *